US005598634A

United States Patent [19]

Berns

[11] Patent Number: 5,598,634

[45] Date of Patent: Feb. 4, 1997

[54] DEBURRING KNIFE WITH ADJUSTABLE HANDLE

[75] Inventor: Harald Berns, Wuppertal, Germany

[73] Assignee: Martor-Argentax E.H. Beermann KG, Solingen, Germany

[21] Appl. No.: 539,589

[22] Filed: Oct. 5, 1995

[30] Foreign Application Priority Data

Oct. 7, 1994 [DE] Germany ..... 44 35 818.0

[51] Int. Cl.[6] ..... B25G 1/06

[52] U.S. Cl. ..... 30/342; 30/340

[58] Field of Search ..... 30/340, 342; 16/115, 16/114 R

[56] References Cited

U.S. PATENT DOCUMENTS

| | | | |
|---|---|---|---|
| 2,592,978 | 4/1952 | Trimboli | 16/115 |
| 2,598,443 | 5/1952 | Roth | 30/340 |
| 2,636,266 | 4/1953 | Sweet | 30/342 |
| 2,865,100 | 12/1958 | Gilbert | 30/340 |

FOREIGN PATENT DOCUMENTS

| | | |
|---|---|---|
| 0400800 | 12/1990 | European Pat. Off. . |
| 8909806 | 11/1989 | Germany . |
| 4112482C1 | 4/1992 | Germany . |
| 572290 | 4/1944 | United Kingdom . |
| 2100169 | 12/1982 | United Kingdom . |
| WO94/05465 | 3/1994 | WIPO . |

*Primary Examiner*—Hwei-Siu Payer
*Attorney, Agent, or Firm*—Herbert Dubno; Andrew Wilford

[57] ABSTRACT

A deburring knife has a body extending along an axis, having a front end, and having a rear end formed with an outer surface, a hollow handle fitted over the rear end and having an inner surface confronting the outer surface of the body and a blade affixed to the handle front end. One of the surfaces is formed with a row of angularly extending and axially spaced holding ridges having outer edges and defining a row of axially spaced, radially open, and angularly extending holding grooves each extending relative to the axis over substantially less than 360°, and an axially extending ridge-free guide. The other of the surfaces is formed with a radially projecting holding ridge engageable in the grooves and on the guide. The guide and ridges are so dimensioned that when the other-surface ridge is aligned in the guide the handle can move axially on the body.

12 Claims, 3 Drawing Sheets

DEBURRING KNIFE WITH ADJUSTABLE HANDLE

FIELD OF THE INVENTION

The present invention relates to a utility knife. More particularly this invention concerns a deburring knife with an adjustable handle.

BACKGROUND OF THE INVENTION

A standard utility knife of the type used for deburring plastic castings has a grip-shaped handle whose front end is provided with a removable steel blade. The rear end of the handle is rounded to fit comfortably in the hand, and the middle region is provided with grip-enhancing formations. In the system described in commonly owned German patent 4,112,482 filed Apr. 17, 1991 by E. Beermann the handle is adjustable with respect to length. To this end its rear portion is formed by a cup-shaped or tubular handle that fits over and is threaded to a stem projecting backward from the front and middle parts of the knife body. Thus this rear handle portion can be screwed on the stem to increase and decrease the length of the knife.

While this arrangement does have the considerable advantage that it allows the knife to be adjusted to fit the user's hand, it has several disadvantages. In order to change the handle length over a wide range, for instance from very short to very long, one must laboriously screw the handle part the whole length of the stem because the pitch of the screwthread is fairly shallow to prevent the handle from screwing in when pushed forward during use. Furthermore assembly of the tool requires a laborious screwing of the handle onto the body, increasing production costs. Once in use it is possible to accidentally screw the handle back off the body, separating the parts so that the real possibility of losing the handle is created.

OBJECTS OF THE INVENTION

It is therefore an object of the present invention to provide an improved adjustable utility knife usable for deburring.

Another object is the provision of such an improved adjustable utility knife usable for deburring which overcomes the above-given disadvantages, that is which is easily adjusted over a wide range, easy to assemble, and not normally separable into parts.

SUMMARY OF THE INVENTION

A deburring knife has according to the invention a body extending along an axis, having a front end, and having a rear end formed with an outer surface, a hollow handle fitted over the rear end and having an inner surface confronting the outer surface of the body and a blade affixed to the handle front end. One of the surfaces is formed with a row of angularly extending and axially spaced holding ridges having outer edges and defining a row of axially spaced, radially open, and angularly extending holding grooves each extending relative to the axis over substantially less than 360°, and an axially extending ridge-free guide. The other of the surfaces is formed with a radially projecting holding ridge engageable in the grooves and on the guide. The guide and ridges are so dimensioned that when the other-surface ridge is aligned in the guide the handle can move axially on the body.

Thus with this system the handle is twisted so that the ridges are not meshed together, the one ridge is aligned with the guide and the handle can be slid along the body to the desired position. Then the user rotates the handle on the body to engage the ridges together and lock the axial position in place. Such a knife can be made longer or shorter easily, and a long adjustment is no more onerous than a short one. Similarly it can be assembled easily, without having to painstakingly screw the handle down on the body.

According to the invention the other surface is the outer surface of the body and the guide is a flat extending along the other surface angularly offset from the row of ridges. The outer edges lie substantially on a cylinder centered on the axis of the knife and the inner surface is substantially cylindrical and coaxial with the axis. Normally the ridge of the handle has an inner edge that rides on the guide in an adjustment position of the handle on the body.

To ease assembly and inhibit disassembly the body is formed at an extreme rear end with a radially inwardly deflectable tongue projecting into axial alignment with the guide and blocking displacement of the handle ridge axially past the tongue so that the tongue inhibits removal of the handle from the body.

Establishing or reestablishing a given setting is possible when the body is formed diametrically opposite the row of holding ridges with a row of indicating ridges and the handle is formed with a radially throughgoing aperture through which the indicating ridges are visible.

In accordance with further features of the invention the ridges and grooves each lie in a plane substantially perpendicular to the axis. The grooves each have a depth that decreases angularly toward a groove end so that the handle holding ridge can wedge in the grooves. In addition the handle is provided with an inwardly projecting retaining bump engaging the body and impeding relative rotation of the body and handle. The guide is a planar flat and the handle ridge has a straight inner edge riding axially on the flat in an adjustment position of the handle on the body. The handle has an outer surface that is a surface of revolution centered on the axis and the handle and body are made of plastic.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
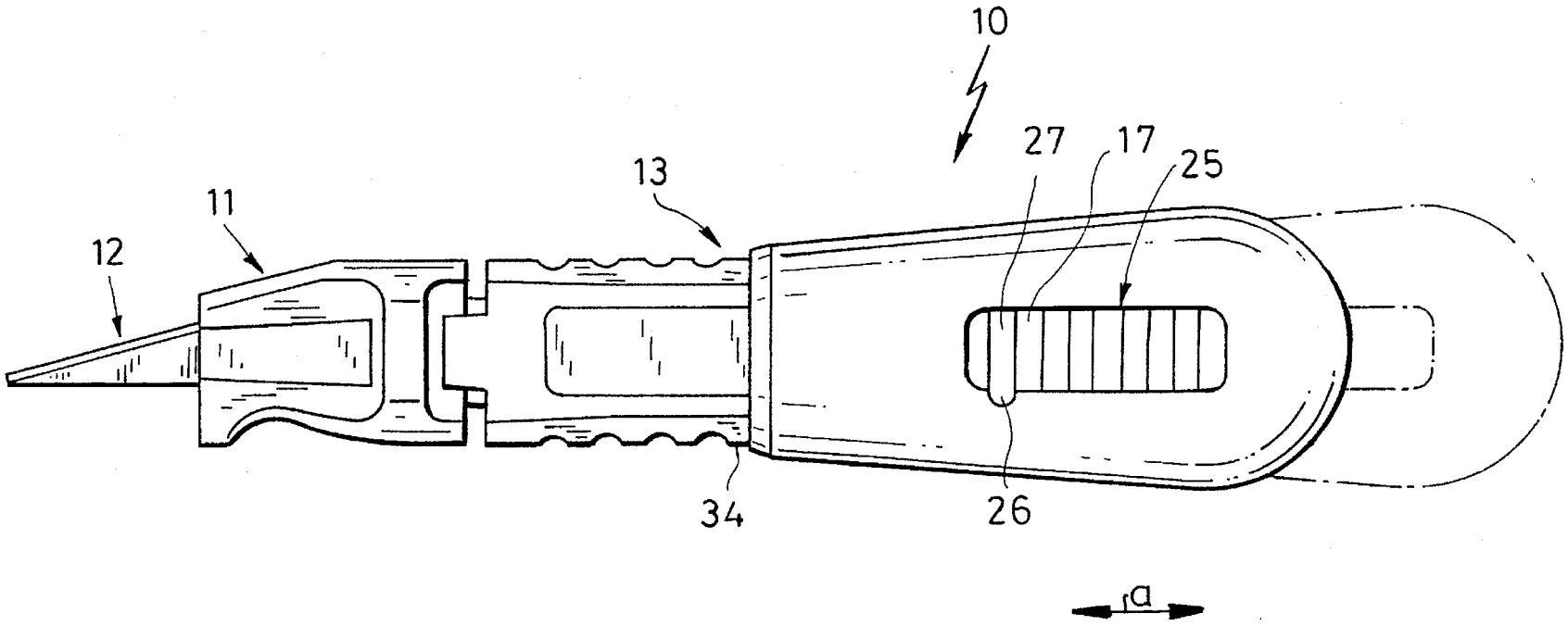
FIG. 1 is a side view of the deburring knife according to the invention.
Figure 2:
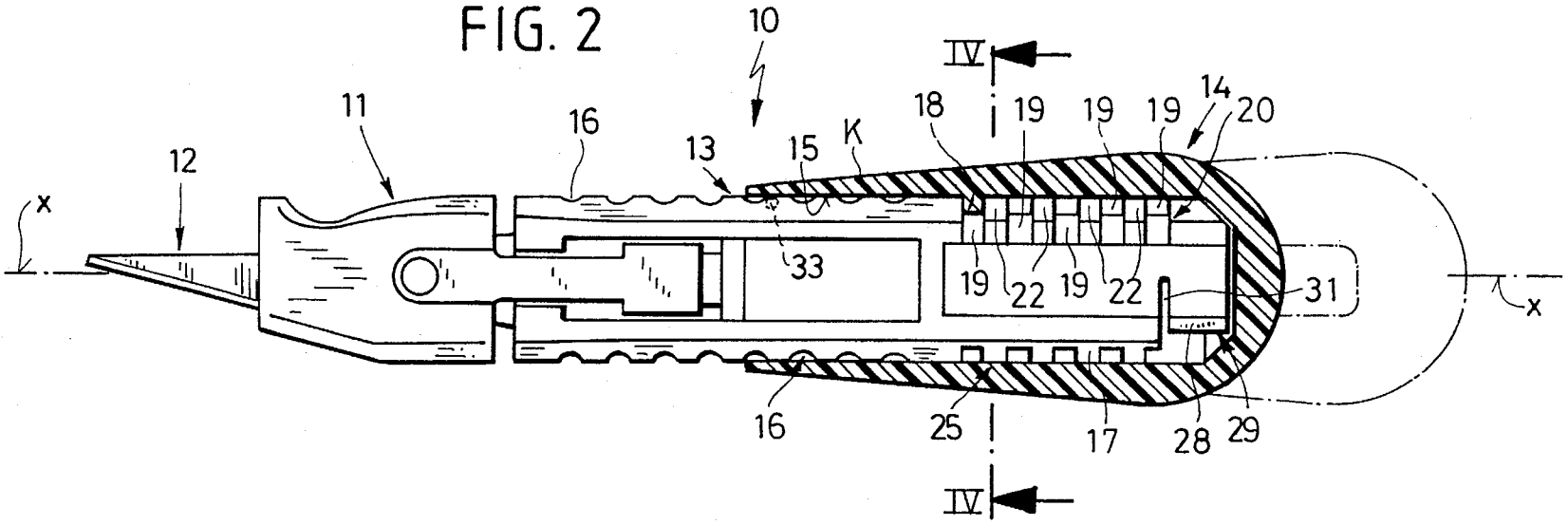
FIGS. 2 and 3 are longitudinal sections through the knife taken along two mutually perpendicular planes, the view of FIG. 2 being from the opposite side as FIG. 1.
Figure 3:
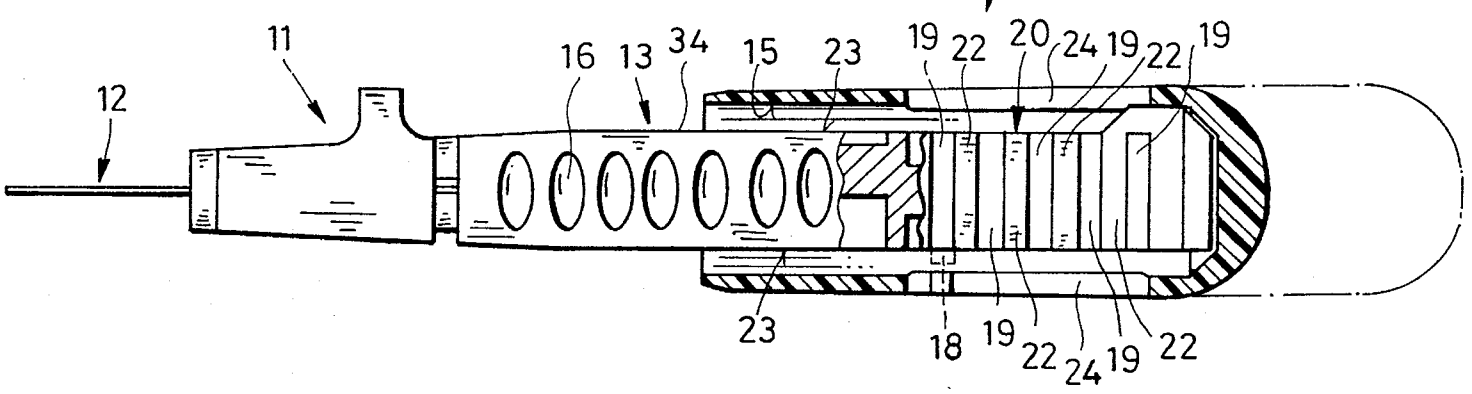

As seen in FIGS. 1 through 3, a knife 10 according to the invention has a body 13 with a front part 11 on which is mounted a blade 12 in the manner described in copending patent application (Ser. No. 08/539,766 filed Oct. 5, 1995) and a back part formed as a stem carrying an adjustable hollow handle 14 and formed with transverse gripping grooves 16. The handle 14 has a generally cylindrical inside surface 15 centered on an axis x and a backwardly flaring gently frustoconical outer surface k ending in a part-spherical end adapted to fit in a user's palm. The body 13 fits into the handle 14 and has a pair of diametrically opposite and longitudinally extending sides 20 and 25 formed with respective rows of transverse ridges 19 and 17 defining respective rows of transverse grooves 22 and 27. The ridges 17 and 19 have outer surfaces that lie on an imaginary cylinder to ride on the cylindrical inside surface 15. Thus the body 13 can rotate at least limitedly in the hollow handle 14 about the axis x on which the body 13 and handle 14 are centered.

The hollow handle 14 is internally formed with an angularly extending ridge or elongated bump 18 adapted to fit in the grooves 22 between the ridges 19 and having a secantally planar inside edge 32. Between the sides 20 and 25, the body 13 is formed with a flat 23 dimensioned so that, when the ridge 18 is aligned with it, the handle 14 can be moved axially on the body 13 as shown in FIG. 3 by arrow a. Otherwise the ridge 18 can engage in any of the grooves 22 to axially fix the handle 14 on the body 13. The grooves 22 have floors 21 that are of semicylindrical shape near the flat 23 but then of increasing radius of curvature so that in effect the grooves get shallower on the side opposite the flat 23, allowing the ridge 18 to wedge in them. The grooves 27 have floors 35 that are secantal and perpendicular to the flat 23 so that the rib 18 cannot enter the grooves 27. The handle 14 is formed with two axially elongated and radially throughgoing slots or windows 24 diametrically opposite each other that can expose the retaining ridges 19 or the indicating ridges 17. One of the windows 24 as shown in FIG. 1 is formed with an indicating formation 26 that can align with one of the indicating grooves 27 between the ridges 17.

Figure 4:
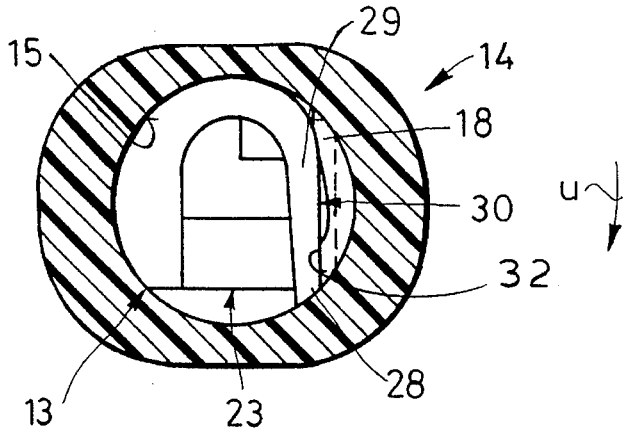
FIG. 4 is a section taken along line IV—IV of FIG.
Figure 5:
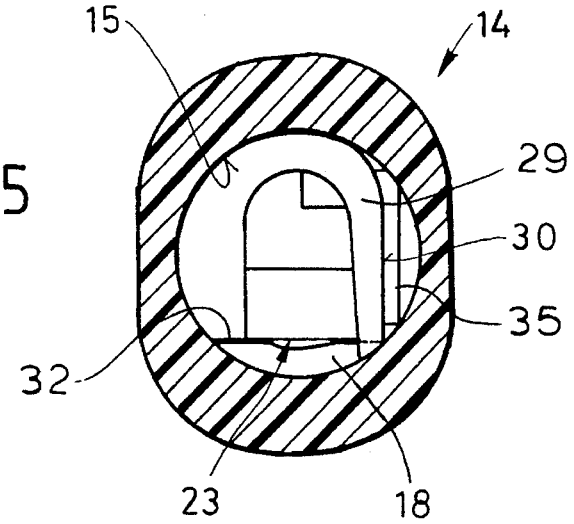
FIGS. 5 and 6 are views like FIG. 4 but in different positions.
Figure 6:
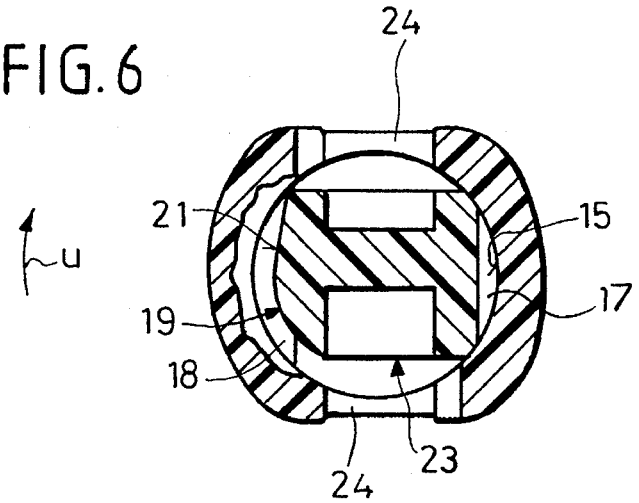

At its rearmost end the body 13 is formed with an angularly extending and elastically deformable tongue 29 having an outer end 28 that normally rides on the inner surface 15 in line with the flat 23 and that is in part defined by a transverse split 31. This tongue 29 prevents the handle 14 from being pulled off the body 13 in that its end projects in the path of the ridge 18 when same is riding on the guide flat 23. During assembly of the knife 10 the tongue 29 is simply deflected inward as the ridge 18 is pushed over it. This is done by fitting the handle 14 to the body 13 as shown in FIG. 4 with the flat inner edge 32 of the ridge 18 lying against a flat outer face 30 of the tongue 28, then rotating the handle 14 90° in direction u clockwise to the position of FIG. 5 while pressing it axially forward, thereby deflecting the tongue 29 inward and seating the ridge 18 in the guide flat 23.

To further hold the handle 14 in position on the body 13, the handle 14 is formed with radially inwardly projecting bumps 33 that fit on the longitudinal edge 34 of the body 13 to hold it in place relative to the handle 14.

I claim:

1. A deburring knife comprising:

a body extending along an axis, having a front end, and having a rear end formed with an outer surface;

a hollow handle fitted over the rear end and having an inner surface confronting the outer surface of the body, one of the surfaces being formed with a row of angularly extending and axially spaced holding ridges having outer edges and defining a row of axially spaced, radially open, and angularly extending holding grooves each extending relative to the axis over substantially less than 360°, and an axially extending ridge-free guide, the other of the surfaces being formed with a radially projecting and angularly elongated holding bump engageable in the grooves and on the guide, the guide, the bump, and the ridges being so dimensioned that when the bump is aligned in the guide the handle can move axially on the body; and a blade affixed to the body front end.

2. The deburring knife defined in claim 1 wherein the other surface is the outer surface of the body and the guide is a flat extending along the other surface angularly offset from the row of ridges.

3. The deburring knife defined in claim 2 wherein the outer edges lie substantially on a cylinder centered on the axis of the knife and the inner surface is substantially cylindrical and coaxial with the axis.

4. The deburring knife defined in claim 3 wherein the bump has an inner edge that rides on the guide in an adjustment position of the handle on the body.

5. The deburring knife defined in claim 2 wherein the body is formed at an extreme rear end with a radially inwardly deflectable tongue projecting into axial alignment with the guide and blocking displacement of the bump axially past the tongue, whereby the tongue inhibits removal of the handle from the body.

6. The deburring knife defined in claim 2 wherein the body is formed diametrically opposite the row of holding ridges with a row of indicating ridges and the handle is formed with a radially throughgoing aperture through which the indicating ridges are visible.

7. The deburring knife defined in claim 2 wherein the ridges and grooves each lie in a plane substantially perpendicular to the axis.

8. The deburring knife defined in claim 2 wherein the grooves each have a depth that decreases angularly toward a groove end, whereby the bump can wedge in the grooves.

9. The deburring knife defined in claim 2 wherein the handle is provided with an inwardly projecting retaining bump engaging the body and impeding relative rotation of the body and handle.

10. The deburring knife defined in claim 2 wherein the guide is a planar flat and the bump has a straight inner edge riding axially on the flat in an adjustment position of the handle on the body.

11. The deburring knife defined in claim 2 wherein the handle has an outer surface that is a surface of revolution centered on the axis.

12. The deburring knife defined in claim 2 wherein the handle and body are made of plastic.

* * * * *